US010131491B2

(12) United States Patent
Marchitto et al.

(10) Patent No.: US 10,131,491 B2
(45) Date of Patent: Nov. 20, 2018

(54) PACKET FOR TOBACCO PRODUCTS AND FLAT BLANK FOR MAKING THE PACKET

(71) Applicant: G.D.S.p.A., Bologna (IT)

(72) Inventors: Giuseppe Marchitto, Lugo di Romagna (IT); Lorena D'Alfonso, Lettomanoppello (IT); Stefano Negrini, Calderara di Reno (IT)

(73) Assignee: G. D S.P.A., Bologna (IT)

( * ) Notice: Subject to any disclaimer, the term of this patent is extended or adjusted under 35 U.S.C. 154(b) by 144 days.

(21) Appl. No.: 14/384,573

(22) PCT Filed: Jun. 20, 2013

(86) PCT No.: PCT/IB2013/055063
§ 371 (c)(1),
(2) Date: Sep. 11, 2014

(87) PCT Pub. No.: WO2013/190494
PCT Pub. Date: Dec. 27, 2013

(65) Prior Publication Data

US 2015/0090618 A1 Apr. 2, 2015

(30) Foreign Application Priority Data

Jun. 20, 2012 (IT) ..... BO2012A0341

(51) Int. Cl.
*B65D 85/10* (2006.01)
*B65D 5/66* (2006.01)
*A24F 15/12* (2006.01)

(52) U.S. Cl.
CPC ..... *B65D 85/1054* (2013.01); *A24F 15/12* (2013.01); *B65D 5/6688* (2013.01); *B65D 5/6694* (2013.01); *B65D 85/1045* (2013.01)

(58) Field of Classification Search
CPC ..... B65D 85/10; B65D 85/1045; B65D 85/1054; B65D 5/66; B65D 5/6688;
(Continued)

(56) References Cited

U.S. PATENT DOCUMENTS 2,114,052 A * 4/1938 Kincade, Jr. ..... B65D 5/02 206/427
3,369,727 A 2/1968 Wright
(Continued)

FOREIGN PATENT DOCUMENTS

CN 1822995 A 8/2006
CN 201002747 Y 1/2008
(Continued)

OTHER PUBLICATIONS

International Search Report dated Jan. 31, 2014 from counterpart application No. PCT/IB2013/055063.
(Continued)

*Primary Examiner* — Andrew Perreault
(74) *Attorney, Agent, or Firm* — Shuttleworth & Ingersoll, PLC; Timothy J. Klima

(57) ABSTRACT

Described is a packet for tobacco products, substantially in the shape of a parallelepiped and extending about a respective main direction, having a front wall, a rear wall facing the front wall, a pair of side walls, a bottom wall and a top wall; the bottom wall and the top wall have a same perimeter extension; the packet also has at least a first and a second corner wall, each of which is interposed between a side wall and the respective front wall or rear wall and has a transversal dimension variable along the main direction; the first corner wall has a geometry complementary to that of the second corner wall in such a way as to keep substantially constant the perimeter extension of each section of the packet transversal to the main direction.

10 Claims, 16 Drawing Sheets

(58) Field of Classification Search
CPC .... B65D 5/6694; B65D 5/029; B65D 5/2038; B65D 5/2033; A24F 15/12
See application file for complete search history.

(56) References Cited

U.S. PATENT DOCUMENTS

| | | | | |
|---|---|---|---|---|
| 4,063,679 | A * | 12/1977 | Henry | B65D 5/3614 229/108 |
| 5,277,304 | A | 1/1994 | Brizzi et al. | |
| 5,277,315 | A | 1/1994 | Plein | |
| D392,802 | S | 3/1998 | Malmborg | |
| 5,901,904 | A * | 5/1999 | Avot | B65B 5/108 229/109 |
| 6,079,556 | A | 6/2000 | Draghetti et al. | |
| 6,079,616 | A * | 6/2000 | Chinks | B65D 5/0005 229/101 |
| D503,616 | S | 4/2005 | Ghini et al. | |
| 7,017,797 | B2 * | 3/2006 | Goglio | B65D 5/14 229/109 |
| D531,498 | S | 11/2006 | Fluegel et al. | |
| D538,156 | S | 3/2007 | Ayats et al. | |
| D545,188 | S | 6/2007 | Billig et al. | |
| D549,096 | S | 8/2007 | Ayats et al. | |
| 7,467,711 | B2 | 12/2008 | Tambo | |
| D700,994 | S | 3/2014 | Alarcon et al. | |
| D718,493 | S | 11/2014 | Stern | |
| D723,736 | S | 3/2015 | Liu | |
| D732,952 | S | 6/2015 | Ghini et al. | |
| D737,135 | S | 8/2015 | Mizutani et al. | |
| D748,466 | S | 2/2016 | Martin et al. | |
| D751,756 | S | 3/2016 | Hearn | |
| D751,757 | S | 3/2016 | Stern | |
| D752,282 | S | 3/2016 | Doster | |
| D752,283 | S | 3/2016 | Doster | |
| D752,286 | S | 3/2016 | Hearn | |
| D752,808 | S | 3/2016 | Hearn | |
| D753,960 | S | 4/2016 | Hart | |
| D764,904 | S | 8/2016 | Moseri | |
| D775,944 | S | 1/2017 | Marchitto | |
| 2004/0050725 | A1 | 3/2004 | Colo et al. | |
| 2005/0263573 | A1 * | 12/2005 | Goglio | B65D 5/0245 229/109 |

FOREIGN PATENT DOCUMENTS

| | | | |
|---|---|---|---|
| CN | 201002738 | Y | 9/2008 |
| DE | 3924165 | A1 | 1/1991 |
| DE | 10125682 | A1 | 11/2001 |
| DE | 102008061661 | | 6/2010 |
| DE | 102008061661 | A1 | 6/2010 |
| EM | DM070763 | | 9/2008 |
| EP | 2363355 | A1 | 9/2011 |
| GB | 162948 | A | 5/1921 |
| IT | BO98A000008 | | 1/1998 |
| JP | 2004511243 | A | 4/2004 |
| JP | 2012511475 | A | 5/2012 |
| WO | 0144077 | | 6/2001 |

OTHER PUBLICATIONS

Notice of Opposition filed by Focke & Co dated Jan. 23, 2017 in counterpart European Patent App No. 13759575.7.
Chinese Office Action dated Sep. 1, 2015 for counterpart Chinese Patent Application No. 201380032729.0.
Japanese Office Action dated Feb. 3, 2017 for counterpart Japanese Patent Application No. 2015-517909.

* cited by examiner

PACKET FOR TOBACCO PRODUCTS AND FLAT BLANK FOR MAKING THE PACKET

This application is the National Phase of International Application PCT/IB2013/055063 filed Jun. 20, 2013 which designated the U.S. and that International Application was published under PCT Article 21(2) in English.

This application claims priority to Italian Patent Application No. BO2012A000341 filed Jun. 20, 2012, which application is incorporated by reference herein.

TECHNICAL FIELD

This invention relates to a packet for tobacco products.

More specifically, this invention is particularly advantageously in the production of cigarette packets of the rigid type obtained from respective flat blanks with lines of weakness made of cardboard, paperboard or plastic material or the like, to which this description will hereinafter refer but without thereby limiting the scope of the invention.

BACKGROUND ART

The traditional type of rigid packet, which is substantially in the shape of a parallelepiped with a rectangular cross section and sharp longitudinal corners, has some drawbacks deriving from its not very anatomic shape, which is not very pleasant to grip, and due to the fact that the above-mentioned longitudinal corners can cause wear to the pockets of the users clothing.

To overcome these types of drawbacks the prior art proposes numerous types of packets having rounded corners or even a substantially elliptical or oval cross section.

For example, the document WO-A-0144077 in the name of the same Applicant as this invention, shows a rigid packet for cigarettes, of the hinged-lid type, having all the longitudinal corners (that is, parallel to a main direction of the packet) rounded, with concavity facing the inside of the packet, in such a way as to eliminate the presence of sharp corners.

This solution, even though it allows the wear of the users clothing to be limited, does not significantly improve the grippability of the packet.

Moreover, it has been found that the absence of sharp longitudinal corners causes a poor structural rigidity resulting in an easy deformability of the packet, especially at the rounded corners.

A further drawback is that the rounded corners can only be achieved with major modifications to the traditional machines for packaging. More specifically, it was necessary to perform complex steps of pre-deforming areas of the blanks that will constitute the strips defining, upon completing the packet, the rounded corners.

Another prior art solution, free from most of the drawbacks mentioned above, is known from the patent publication ITBO98A000008, again in the name of the same Applicant as this invention, which illustrates a packet for cigarettes, of the hinged-lid type, wherein at the longitudinal corners there are connecting walls having a same variable dimension along the main direction of the packet.

In this way, the perimeter extension of the packet has a maximum value and a minimum value, at a gripping area.

In other words, the connecting walls with variable dimensions allow the cross section of the packet to be reduced in at least one predetermined area thereby facilitating the gripping.

Disadvantageously, this solution has been found to be problematic in the steps of wrapping the packet.

In effect, the traditional cellophaning machines, designed to wrap the packets with a transparent outer wrapping sheet, provided for parallelepiped packets with sharp longitudinal corners, have been found to be unsuitable for that operation on those types of packets.

More specifically, in the area with a minimum cross section it becomes difficult to perform a correct wrapping of the packet and spaces are created with consequent formation of unattractive creases and folds.

DISCLOSURE OF THE INVENTION

The basic technical purpose of this invention is to provide a packet for tobacco products which is free of the above mentioned drawbacks.

More specifically, the aim of this invention is to provide a rigid packet for tobacco products which can easily be held and at the same time is easy to pack.

The technical purpose indicated and the aim specified are achieved by a packet for tobacco products comprising the technical features set out herein.

Moreover, the technical purpose indicated and the aim specified are achieved by a flat blank for making the packet comprising the technical features set out herein.

BRIEF DESCRIPTION OF DRAWINGS

The invention is described below with reference to the accompanying drawings, which illustrate non-limiting embodiments of it, and in which.

DETAILED DESCRIPTION OF PREFERRED EMBODIMENTS OF THE INVENTION

Figure 1:
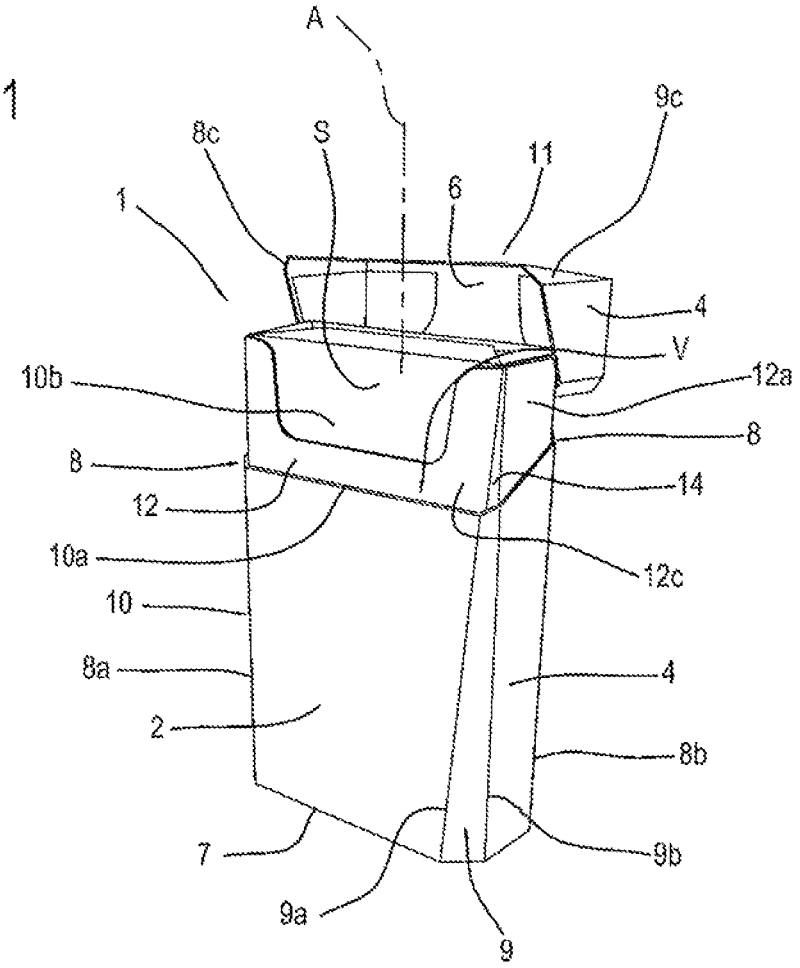
FIG. 1 is a front perspective view of a first embodiment of the packet according to the invention, in an open configuration.
Figure 1A:
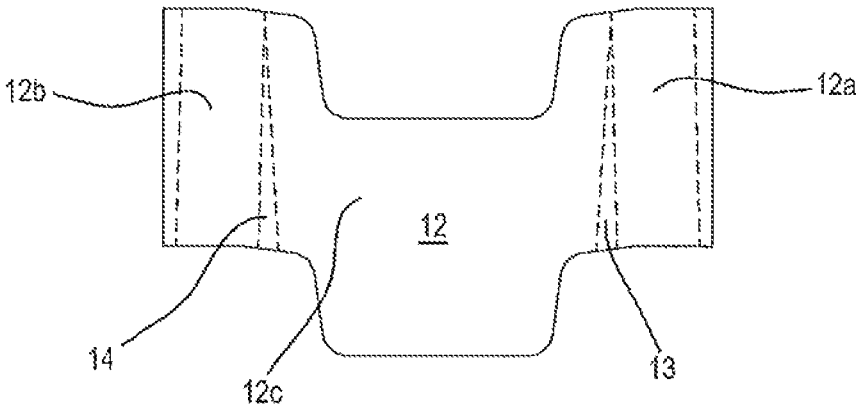
FIG. 1*a* is a plan view of a blank for making a detail of the packet of FIG. 1.

With reference to the accompanying drawings, the numeral 1 denotes a packet for tobacco products according to this invention.

Hereinafter in this description, reference is made to smokers' articles consisting of cigarettes, without thereby restricting the scope of the invention.

It should be noted that the packets described are of the hinged-lid type, however this invention refers to any type of packet for tobacco products, whether it is of the hinged-lid or another type.

The packet 1 is of the rigid type, extending substantially in the shape of a parallelepiped about a main direction "A" and has inside a compartment designed to accommodate a group "S" of cigarettes.

More specifically, the main direction "A" is the direction along which the packet 1 mainly extends.

More specifically, the packet 1 comprises a front wall 2, a rear wall 3 facing the front wall 2, a pair of side walls 4, 5, a bottom wall 7 and a top wall 6.

The front wall 2 is substantially flat and extends parallel to the rear wall 3, whilst the two side walls 4, 5 (which are parallel to each other) are transversal to them.

The bottom wall 7 and the top wall 6 are (at least in a closed configuration of the packet 1) at right angles to the main direction "A" and have a plurality of sides from which the front wall 2, rear wall 3 and side walls 4, 5 extend.

Figure 2A:
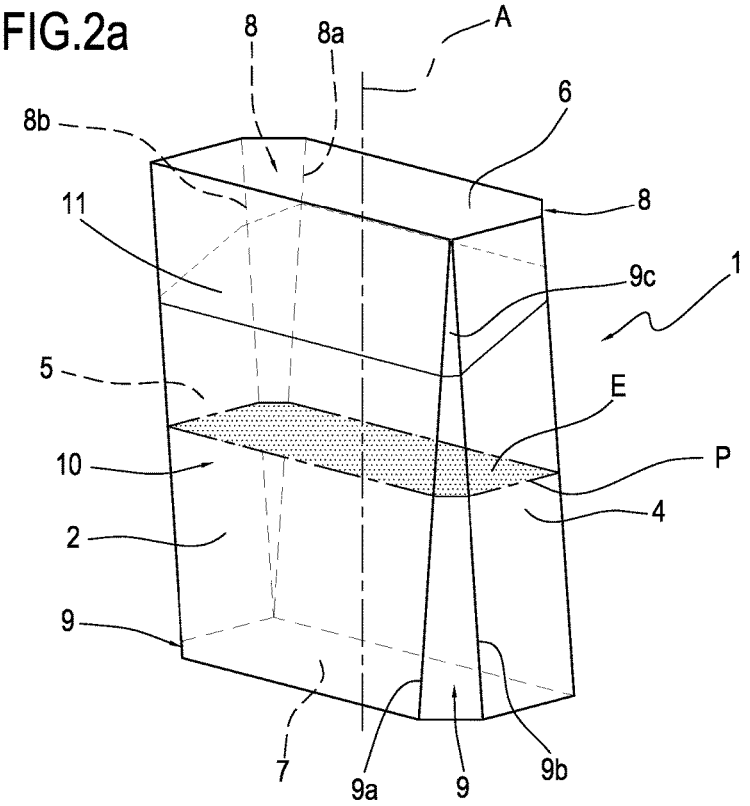
FIGS. 2*a* and 2*b* are front and rear perspective views, respectively, of the packet of FIG. 1 in the closed configuration.
Figure 2B:
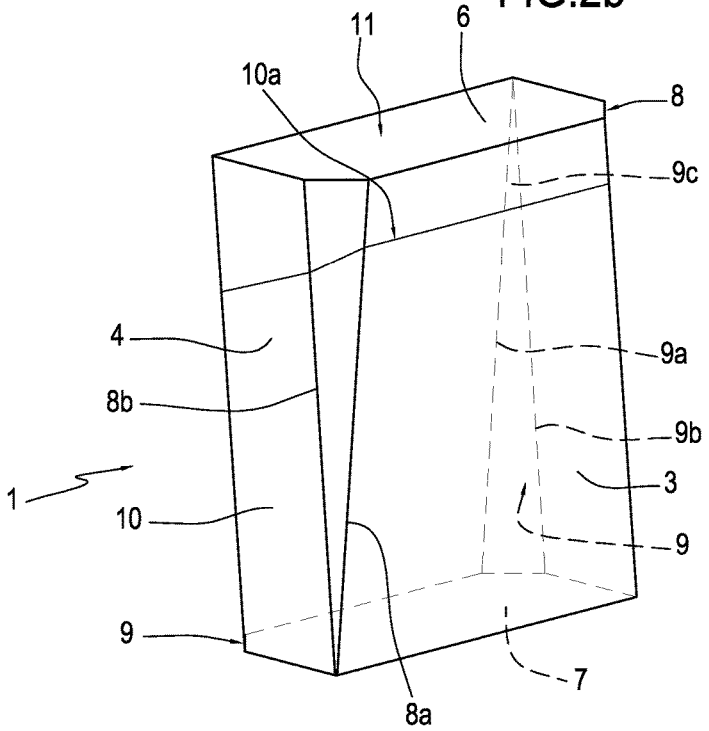

It should be noted that the bottom wall 6 and the top wall 6 have a same perimeter extension length "P" which, for the sake of simplification, has been shown only in FIG. 2*a*, but which also applies to the other embodiments as well.

Consequently, the perimeter of the bottom wall 7 is equal (in value) to the top wall 6.

Moreover, the bottom wall 7 also has the same geometry as the top wall 6, but off-set relative to it.

According to this invention, the packet 1 comprises at least one first corner wall 8 and at least one second corner wall 9, each interposed between a side wall 4, 5 and the respective front wall 2 or rear wall 3.

In other words, the packet 1 comprises at least two corner walls inclined relative to both the front wall 2 or rear wall 3 and the respective side wall 4, 5.

The first corner wall 8 and the second corner wall 9 have a transversal dimension variable along the main direction "A" of the packet 1.

More specifically, the first corner wall 8 and the second corner wall 9 have a transversal dimension variable linearly along the main direction "A" of the packet 1.

The term "transversal" is used to mean a dimension measured transversely (more specifically, on a plane at a right angle) to the main direction "A" of the packet 1.

More in detail, each corner wall 8, 9 extends between two edges 8*a*, 8*b*, 9*a*, 9*b*, each connected respectively to the front wall 2 or rear wall 3 and to the side wall 4, 5.

Consequently, the measurement of the distance between two edges 8*a*, 8*b*, 9*a*, 9*b* of a single corner wall 8, 9 is variable along the main direction "A".

Thus, for different transversal cross sections (that is, at right angles to the main direction "A") of the packet 1 there is a different transversal dimension of each corner wall 8, 9.

So as to keep the perimeter constant (that is, the perimeter extension length "P") of each transversal cross section (indicated as "E" in FIG. 2*a*), the first corner wall 8 has a geometry complementary to that of the second corner wall 9.

The term "complementary" in this text is used to specify that a variation of the transversal dimension of the first corner wall 8 corresponds to an equal and opposite variation of the transversal dimension of the second corner wall 9.

In other words, an increase in the transversal dimension of the first corner wall 8 corresponds with a decrease in the transversal dimension of the second corner wall 9 (and vice versa), such that the sum of the two transversal dimensions is kept constant.

Advantageously, in this way the sum of the transversal dimensions is kept constant along the entire extension of the packet along the main direction "A".

Moreover, in this way a greater grippability is obtained without adversely affecting its packing, since although there is a variation in the shape of the packet along the main direction "A" its perimeter extensions remains constant.

This prevents the formation of spaces or folds in the cellophaning of the packet 1.

Preferably, the first corner wall 8 has an increasing transversal dimension towards the top wall 6 and the second corner wall 9 has a decreasing transversal dimension complementing the first corner wall 8.

Thus, the two edges 8*a*, 8*b* of the first corner wall 8 have an extension diverging away from each other along the main direction "A" towards the top wall 6.

On the contrary, the two edges 9*a*, 9*b* of the second corner wall 9 have an extension diverging away from each other along the main direction "A" towards the bottom wall 7.

Still more preferably, according to the embodiments illustrated, the edges 8*a*, 8*b*, 9*a*, 9*b* of the corner walls 8, 9 have a single curvature, that is, they do not have changes in curvature.

In some embodiments (FIGS. 1-9*b*, 11*a*-14*b*), the corner walls 8, 9 extend along the entire extension of the packet 1, between a first end connected to the bottom wall 7 and a second end connected to the top wall 6.

Alternatively, as illustrated in FIGS. 10*a*, 10*b*, 15*a*, 15*b*, the corner walls 8, 9 have a partial extension, wherein one end is connected to the bottom wall 7 or the top wall 6, whilst the other end is connected in an intermediate area of the longitudinal extension of the packet 1.

Figure 10A:
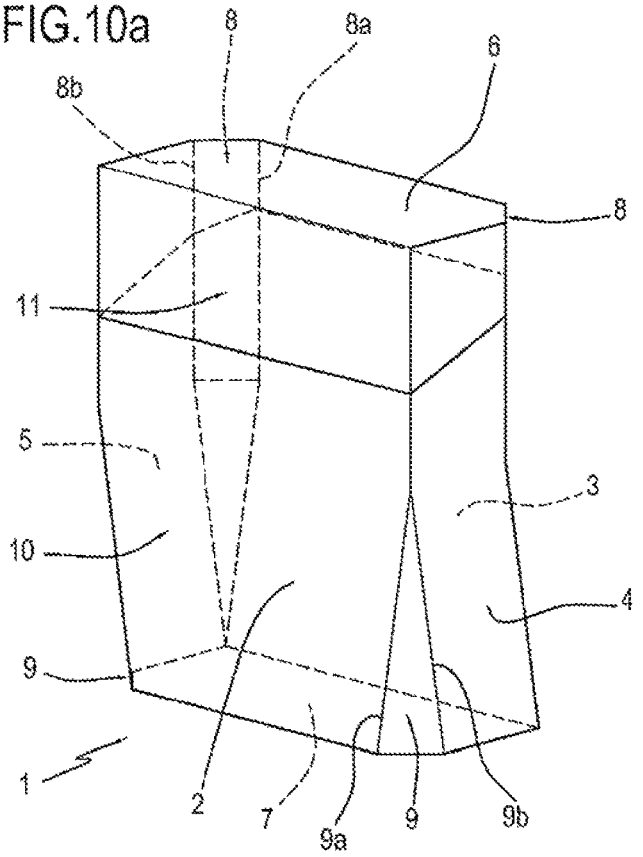
FIGS. 10*a* and 10*b* are front and rear perspective views, respectively, of a fifth embodiment of the packet according to this invention.
Figure 10B:
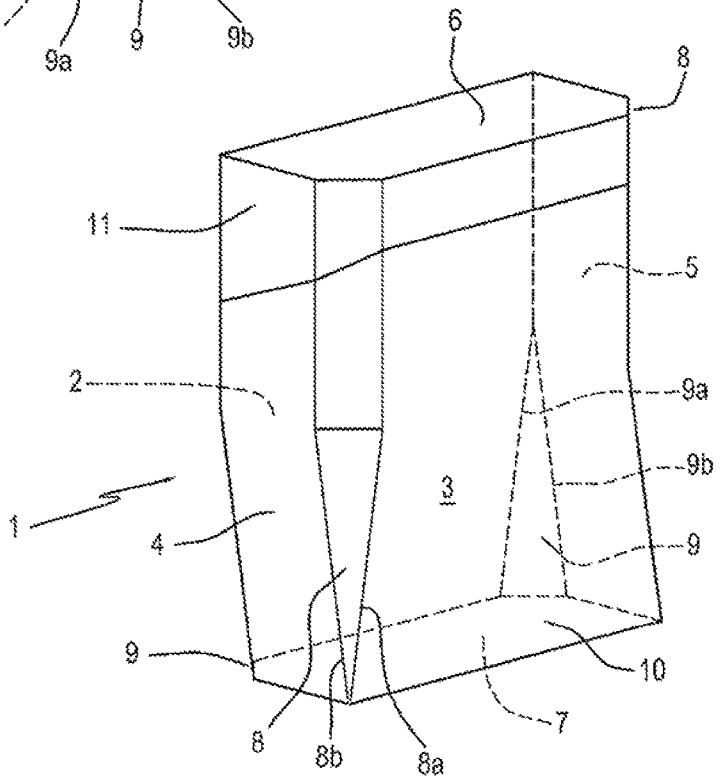
Figure 11A:
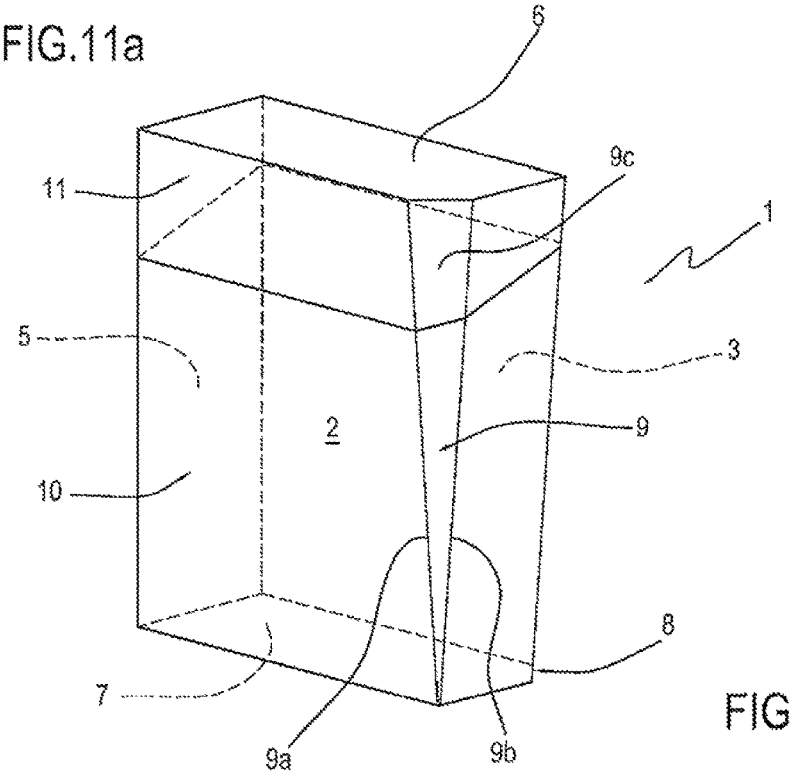
FIGS. 11*a* and 11*b* are front and rear perspective views, respectively, of a sixth embodiment of the packet according to this invention.
Figure 11B:
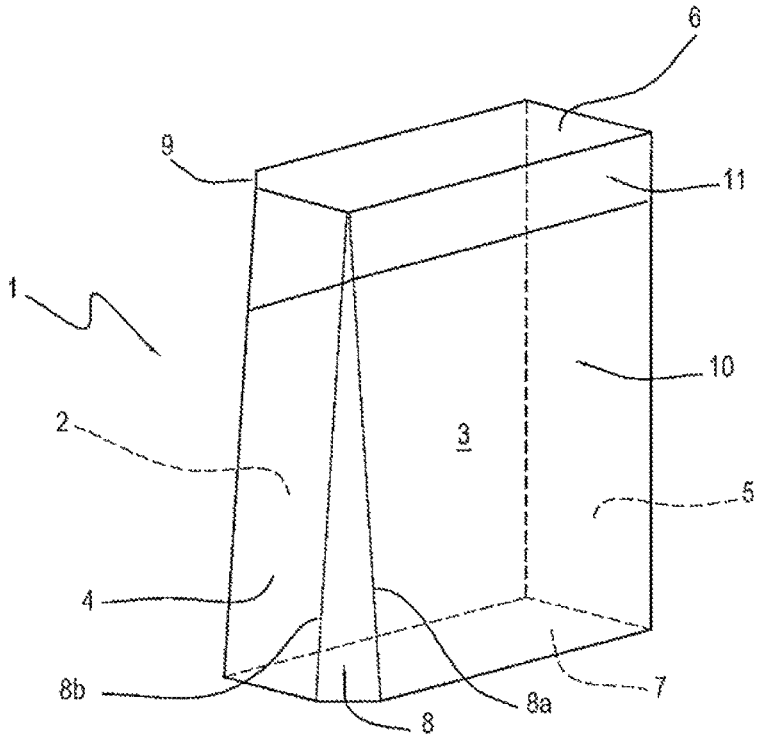
Figure 12A:
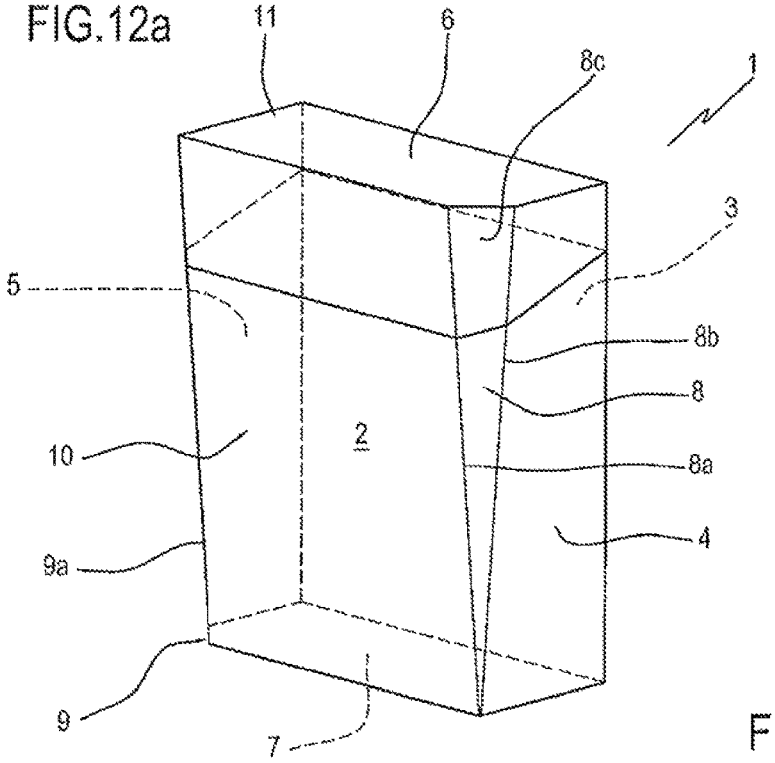
FIGS. 12*a* and 12*b* are front and rear perspective views, respectively, of a seventh embodiment of the packet according to this invention.
Figure 12B:
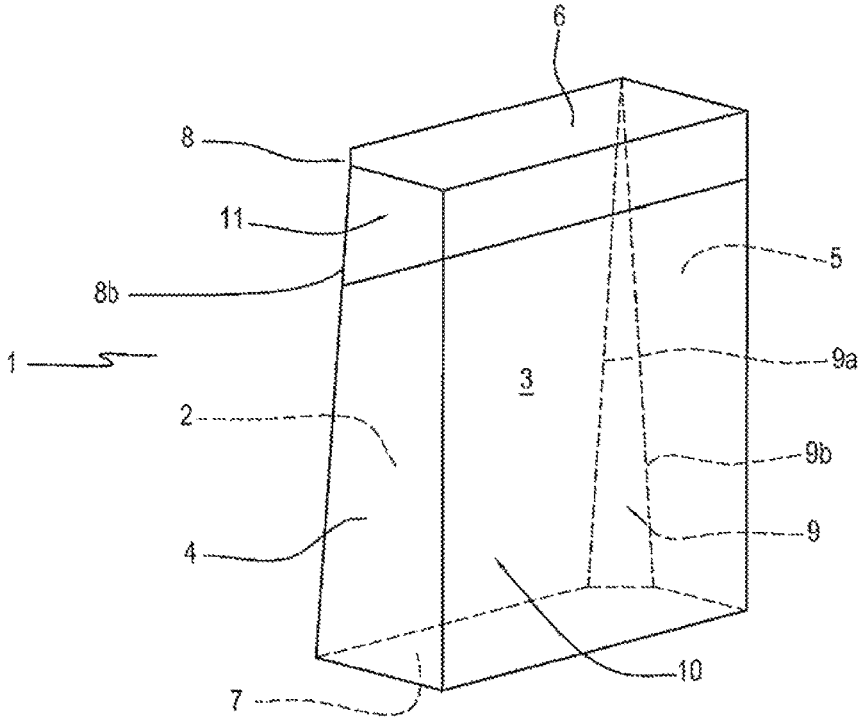
Figure 13:
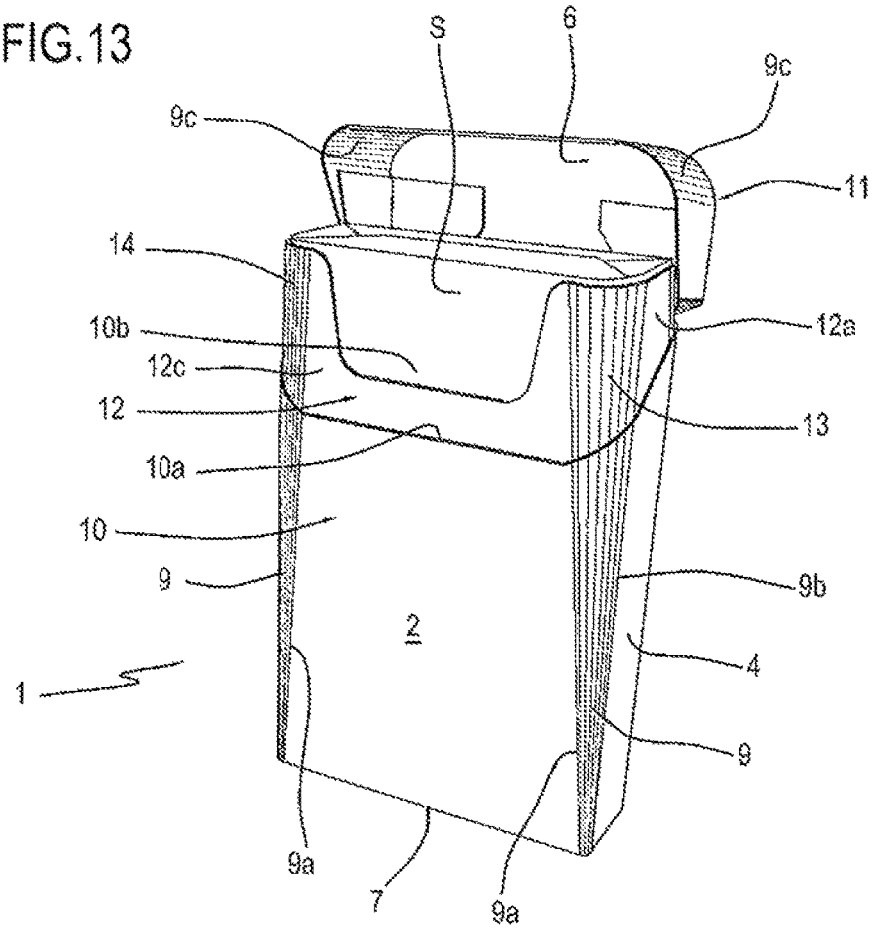
FIG. 13 is a front perspective view of an eighth embodiment of the packet according to the invention, in an open configuration.
Figure 13A:
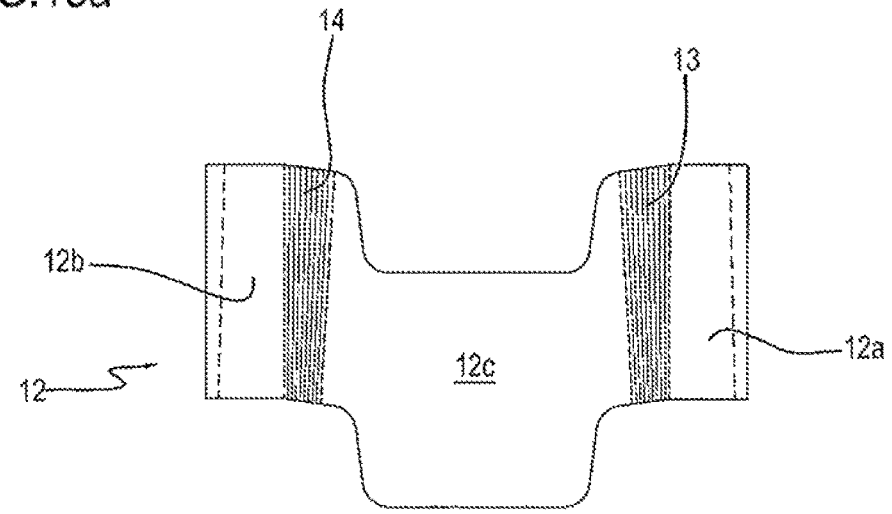
FIG. 13*a* is a plan view of a blank for making a detail of the packet of FIG. 13.
Figure 14A:
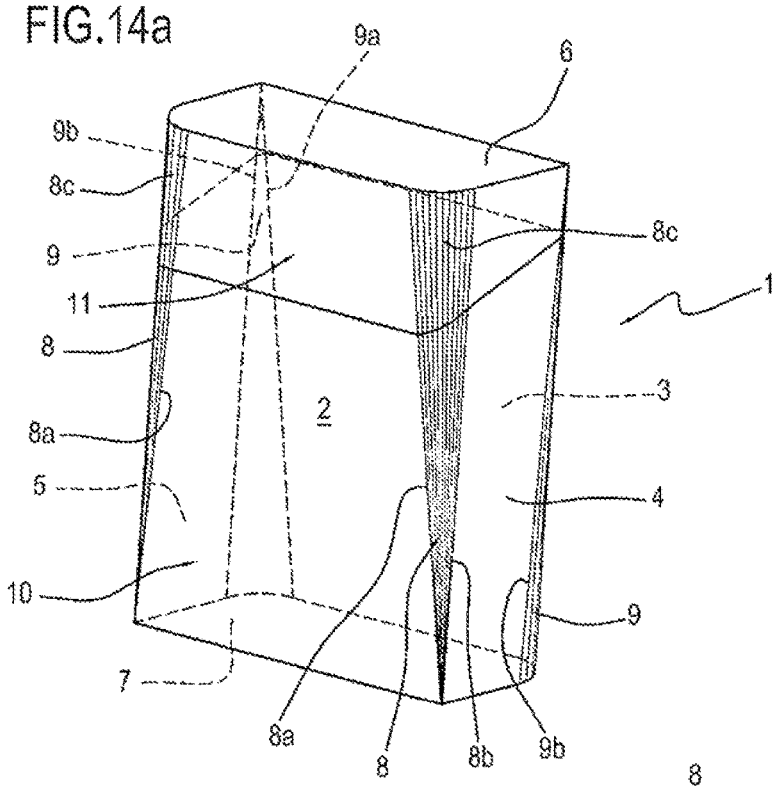
FIGS. 14*a* and 14*b* are front and rear perspective views, respectively, of the packet of FIG. 13 in the closed configuration.
Figure 14B:
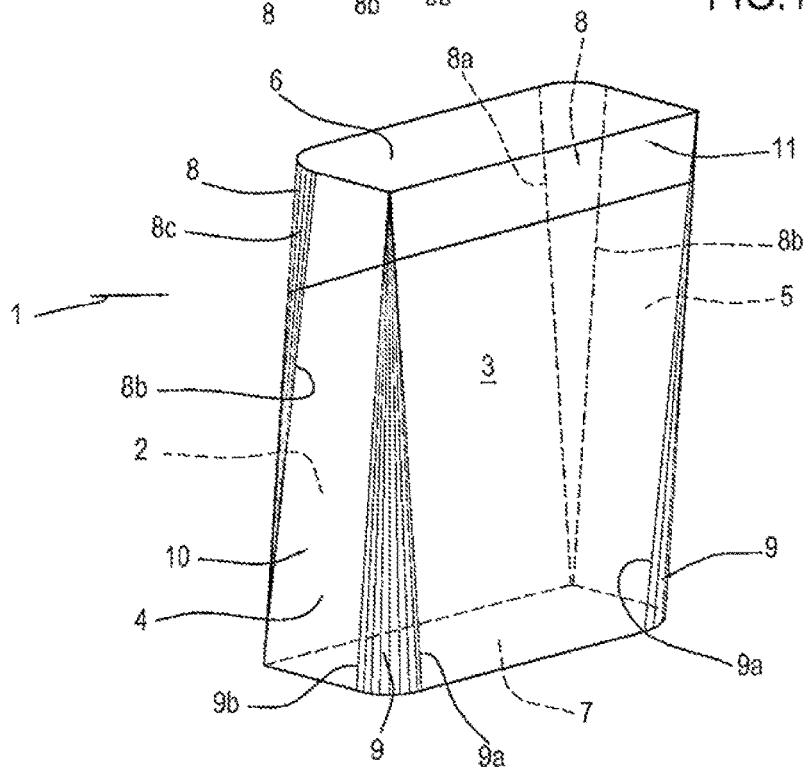

In the embodiment shown in FIGS. 10 10*b*, each corner wall 8, 9 has a triangular geometry. Thus, the first corner wall has a first half-part with a triangular shape having a vertex at the bottom wall 7 or top wall 6, and a second half-part with a constant shape defining a bevel between the front wall 2 or rear wall 3 and the respective side wall 4, 5.

On the other hand, the second corner wall 9 extends between a first end located at the bottom wall 7 and a second end which defines a joining point between the front wall 2 or rear wall 3 and the respective side wall 4, 5, then continuing as an edge.

Figure 15A:
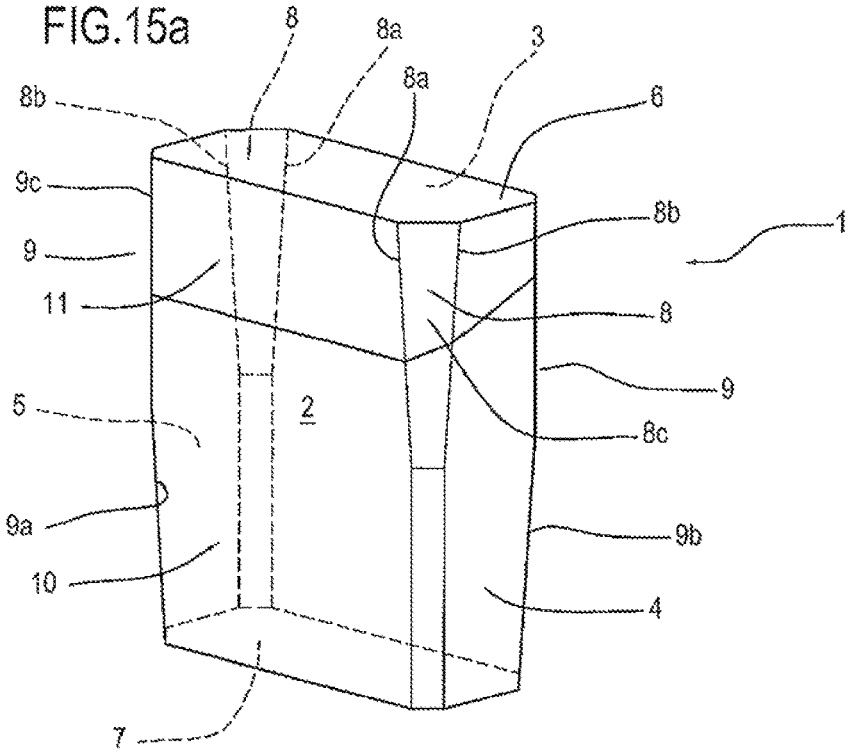
FIGS. 15*a* and 15*b* are front and rear perspective views, respectively, of a ninth embodiment of the packet according to this invention.
Figure 15B:
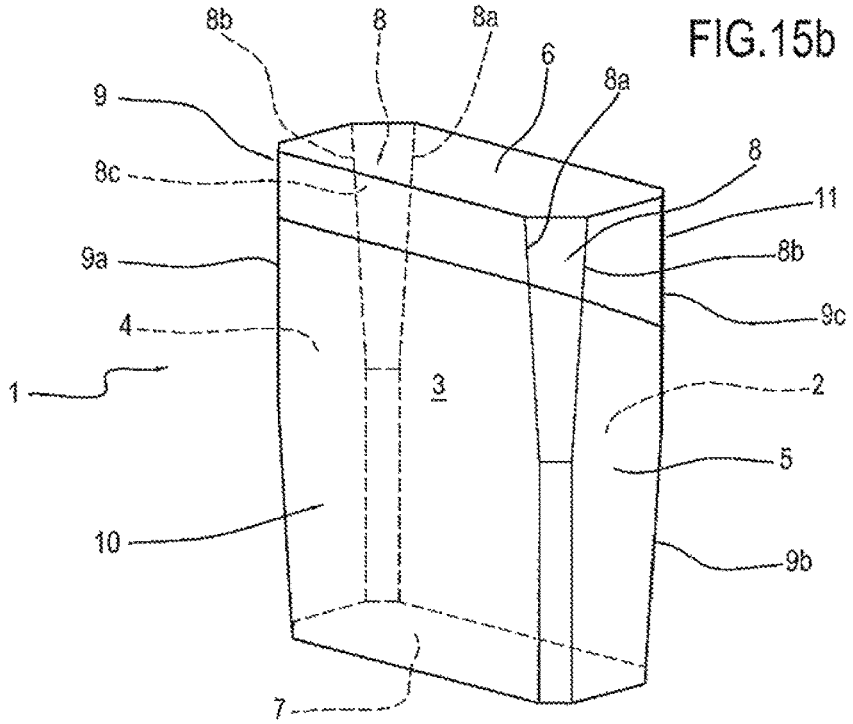
Figure 16A:
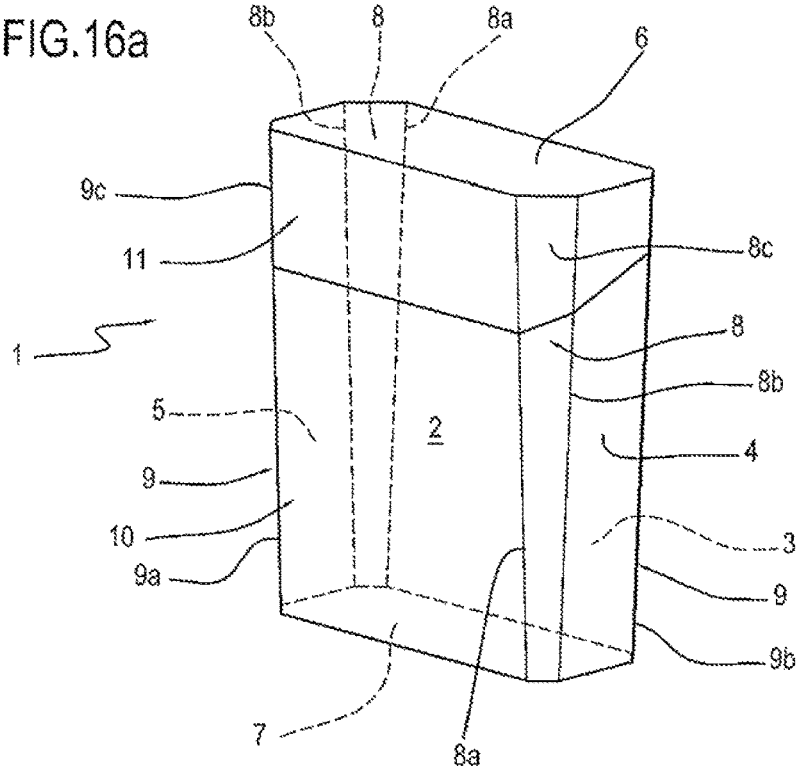
FIGS. 16*a* and 16*b* are front and rear perspective views, respectively, of a tenth embodiment of the packet according to this invention.
Figure 16B:
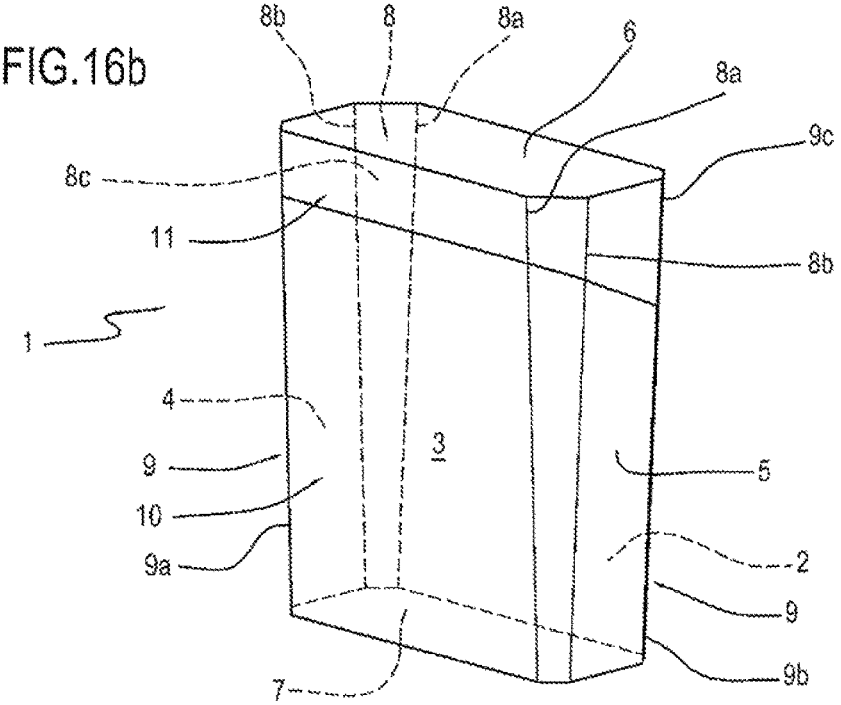

Alternatively (FIGS. 15*a*, 15*b*, 16*a*, 16*b*), the corner walls 8, 9 have a trapezoidal geometry. In a similar fashion to the triangular shape, the trapezoidal shape can also extend for the entire length of the wall (FIGS. 16*a*, 16*b*), or only for a part of it (FIGS. 15*a*, 15*b*).

Preferably, the corner walls 8, 9 have a substantially planar shape. More specifically, they lie on respective planes inclined with an angle of between 20 and 80 degrees, preferably between 30 and 60 degrees, more preferably equal to 45 degrees, relative to the adjacent side wall 4, 5.

It should be noted that, alternatively, the corner walls 8, 9 can have a curved surface (FIGS. 13-14*b*) for connecting between the side wall 4, 5 and the respective front wall 2 or rear wall 3.

In this embodiment, each corner wall 8, 9 has a cone or truncated cone shaped geometry.

Advantageously, in this latter embodiment (curved shape) the corner walls 8, 9 define, in at least one of their portions with a larger transversal dimension, joints between the front wall 2 or rear wall 3 and the respective side wall 4, 5, making the gripping more pleasant for the user.

It should be noted that the first corner wall 8 and the second corner wall 9 can be arranged at any angle between the front wall 2 or rear wall 3 and the respective side wall 4, 5.

Figure 5A:
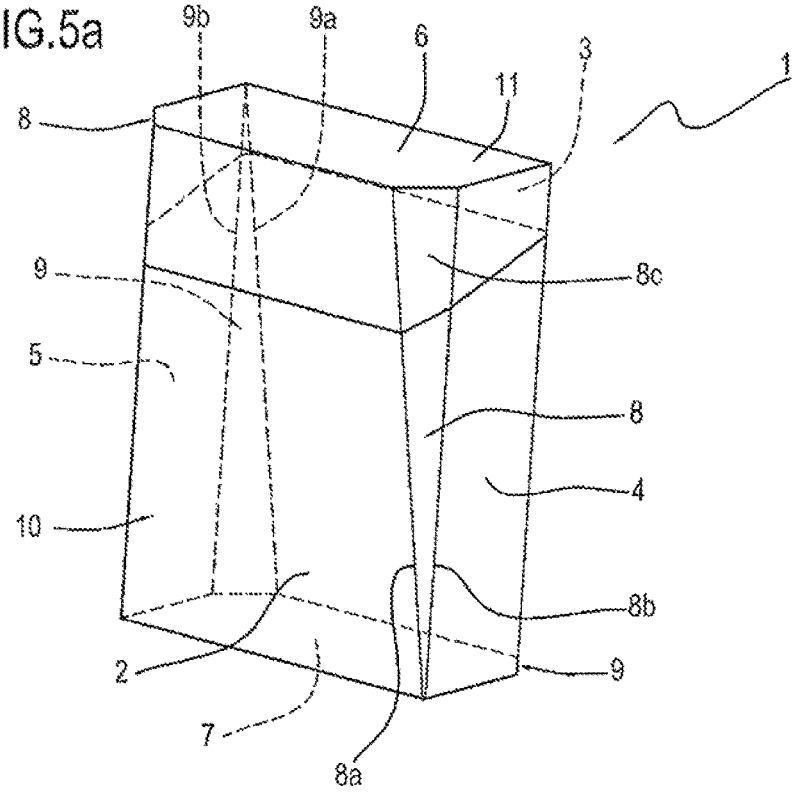
FIGS. 5*a* and 5*b* are front and rear perspective views, respectively, of a second embodiment of the packet of according to this invention.
Figure 5B:
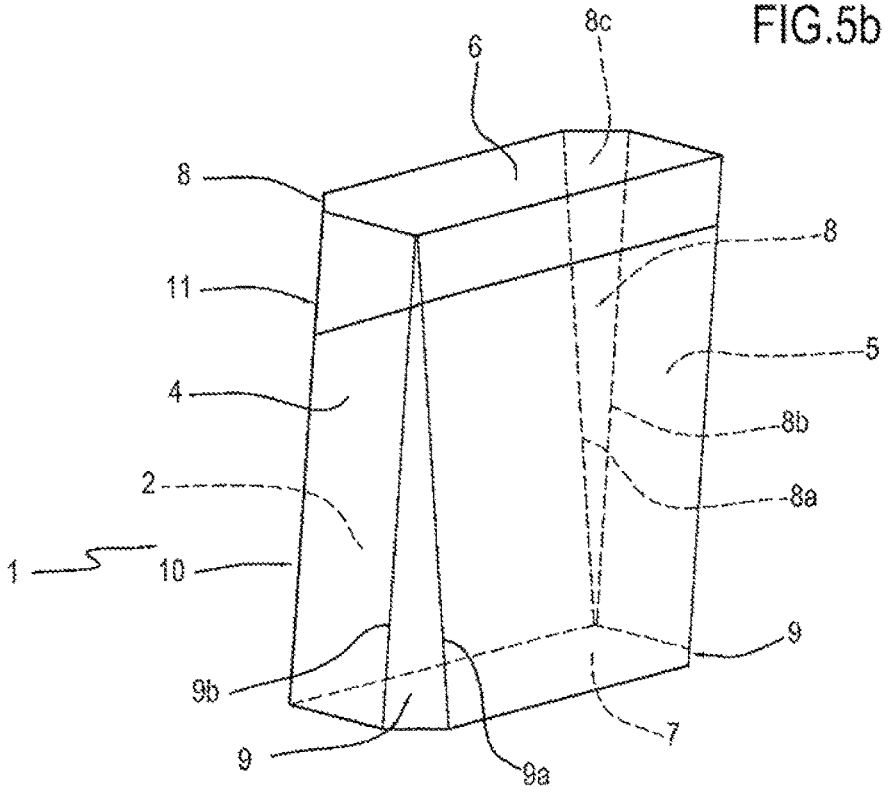
Figure 6:
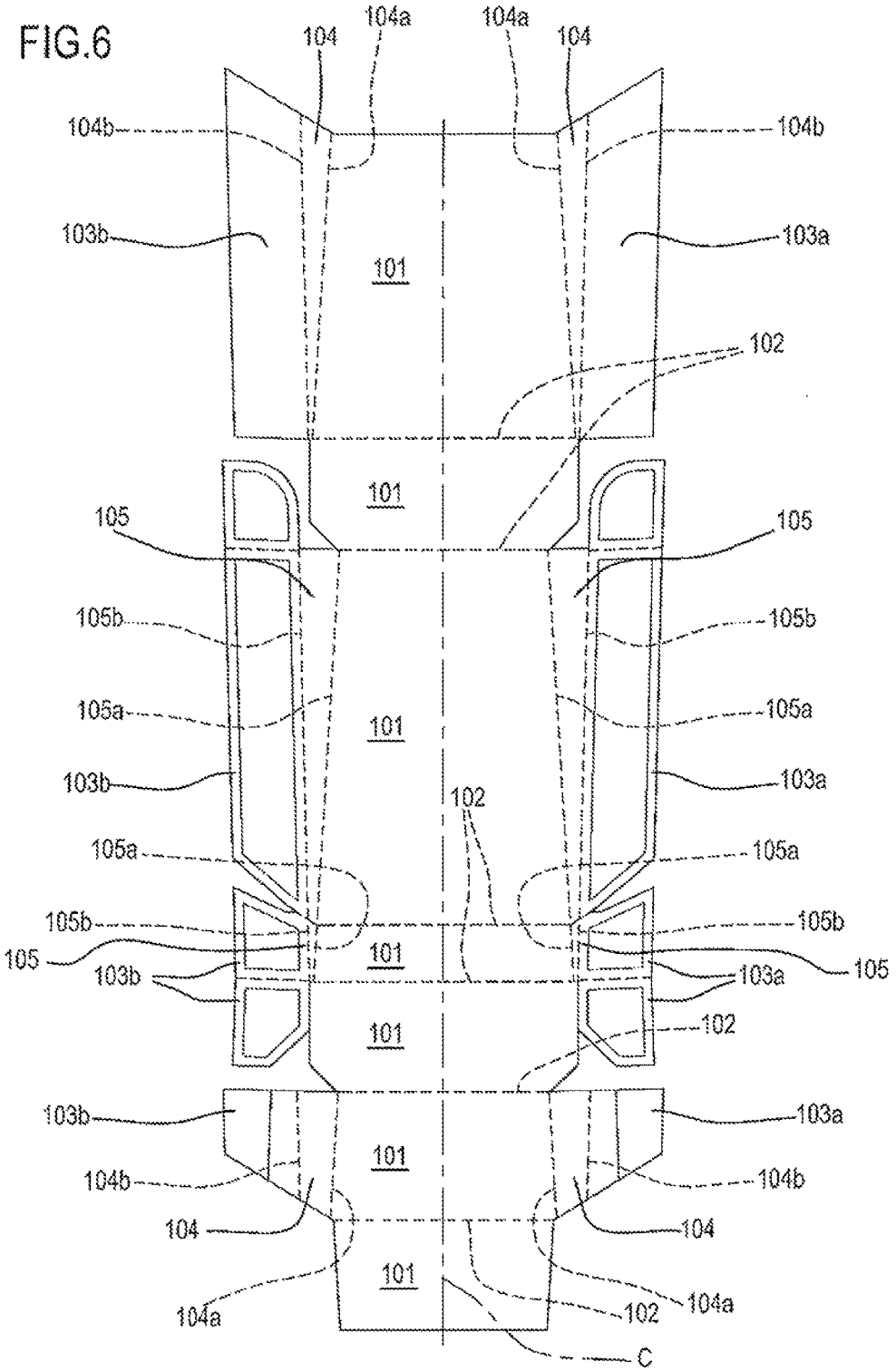
FIG. 6 shows a blank used for making the packet of FIGS. 5*a* and 5*b;*

In the embodiment shown in FIGS. 5*a*, 5*b*, the first corner wall 8 and the second corner wall 9 are each interposed between the front wall 2 and a respective side wall 4, 5.

In the embodiment shown in FIGS. 7*a*, 7*b*, 11*a*, 11*b*, the first corner wall 8 and the second corner wall 9 are each interposed between a same side wall 4 and respectively the front wall 2 and the rear wall 3.

Figure 3E:
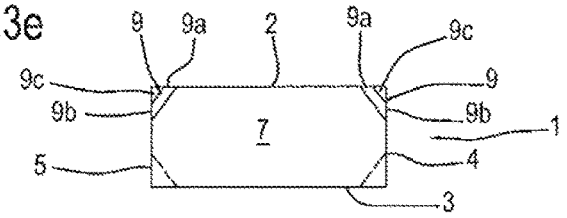
FIGS. 3*a*-3*f* show the right angle projections of the packet of FIG. 1 in its closed configuration.
Figure 3B:
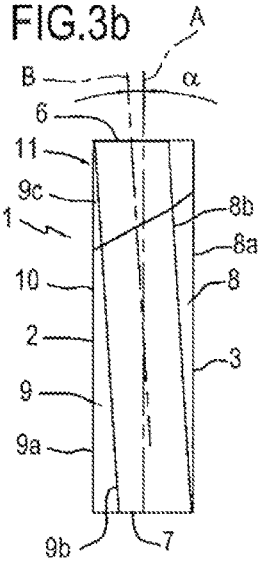
Figure 3A:
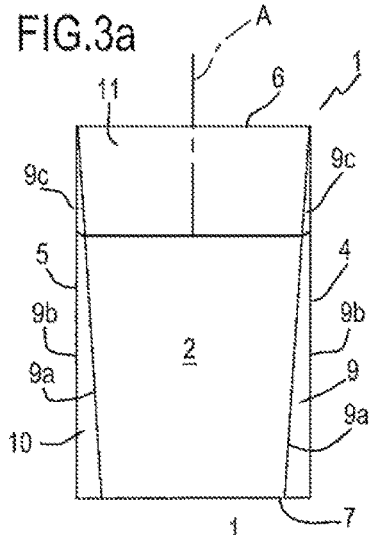
Figure 3C:
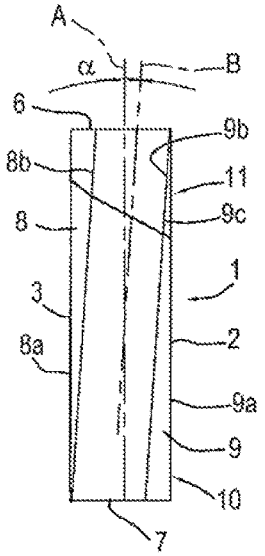
Figure 3D:
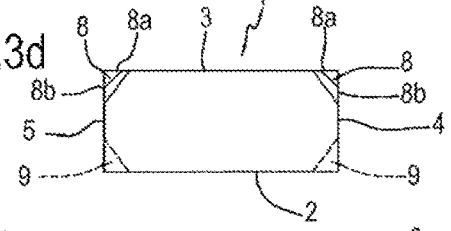
Figure 3F:
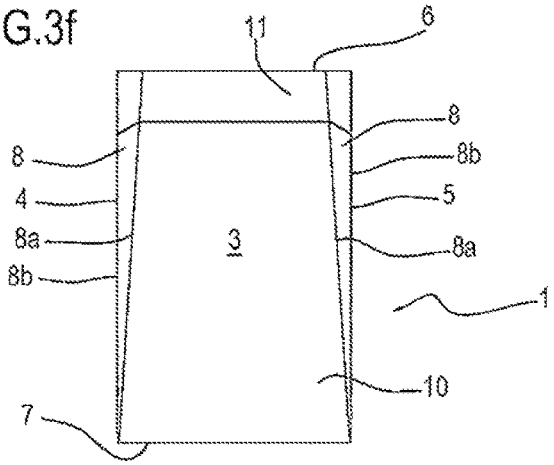
Figure 4:
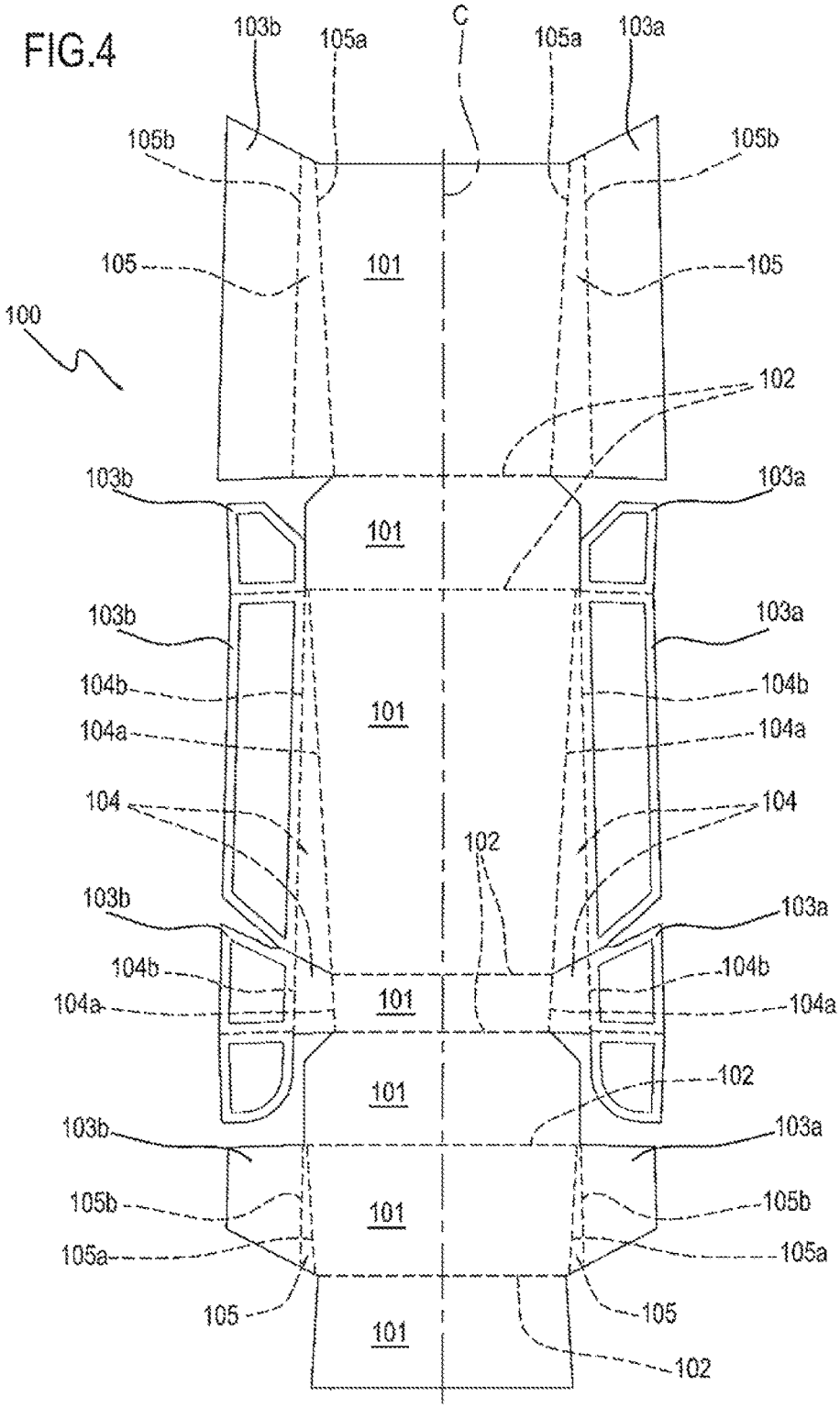
FIG. 4 shows a blank used for making the packet of FIG. 1.

It should be noted that in the above-mentioned embodiments the side wall 4, 5 or the front wall 2 or the rear wall 3 interposed between the first corner wall 8 and the second corner wall 9 have a direction of extension "B" inclined by a predetermined angle $\alpha$ relative to the main direction "A" (FIGS. 3*b*, 3*c*).

Preferably, the side wall 4, 5 or the front wall 2 or the rear wall 3 interposed between the first corner wall 8 and the second corner wall 9 has the geometry of a parallelogram the inclined sides of which are defined by respective edges 8*a*, 8*b*, 9*a*, 9*b* of the first corner wall 8 and the second corner wall 9.

Figure 9A:
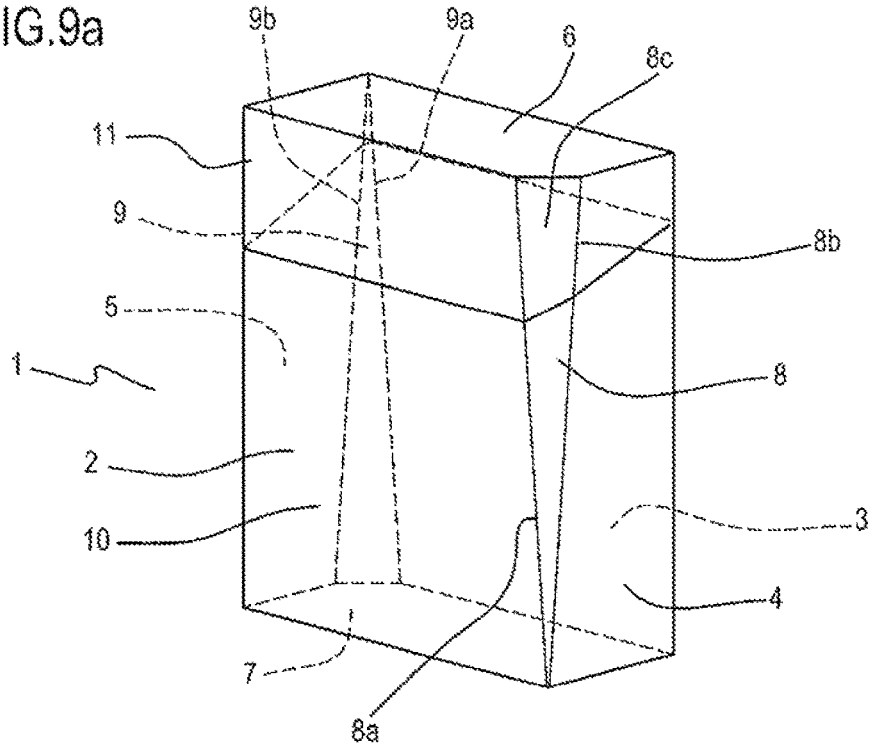
FIGS. 9*a* and 9*b* are front and rear perspective views, respectively, of a fourth embodiment of the packet according to this invention.
Figure 9B:
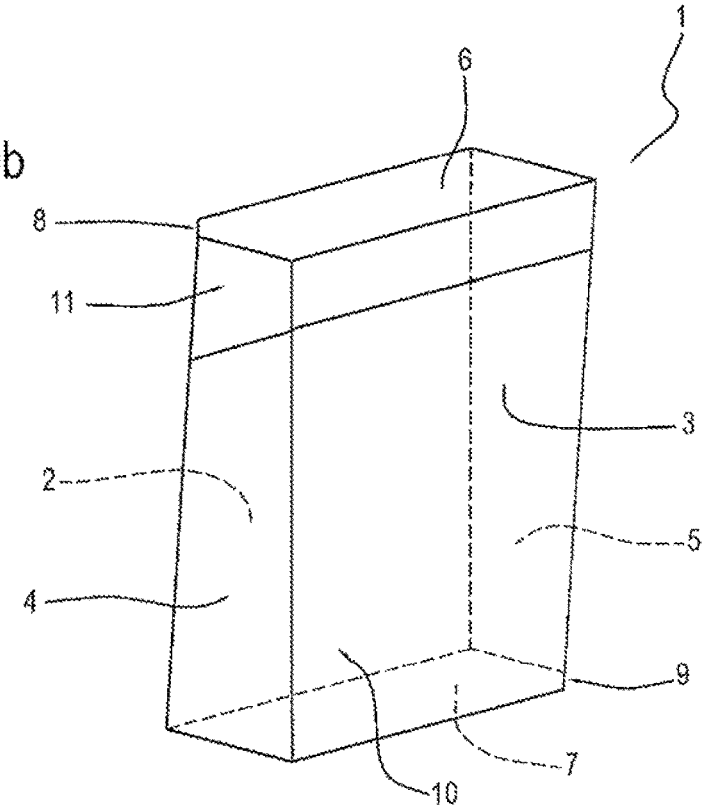

In the embodiment shown in FIGS. 9*a*, 9*b*, the first corner wall 8 is interposed between the front wall 2 and a side wall 4, whilst the second corner wall 9 is interposed between the rear wall 3 and the other side wall 5, that is, they are positioned along a diagonal plane of the packet 1.

Thus, in this embodiment, both the front faces 2 and the rear faces 3 and the side faces 4, 5 have a trapezoidal geometry.

Advantageously, in this way the packet is particularly easy to grip as the bevelled corner walls 9, 8 are made at the areas gripped by the user.

Preferably, the packet 1 (FIGS. 1-8*a*) comprises a pair of first corner walls 8 and a pair of second corner walls 9.

Thus, in these embodiments, the packet has four corner walls 8, 9, which replace completely the sharp corners at right angles of normal packets.

In a similar fashion to the above-mentioned embodiments (as well as in the spirit of this invention), each first corner wall 8 has a geometry complementing that of a respective second corner wall 9 in such a way as to keep substantially constant the perimeter extension of each section transversal to the main direction "A".

In the embodiment of FIG. 1, each first corner wall 8 is symmetrical to the other first corner wall 8 with respect to a midplane transversal to the front wall 2 and parallel to the main direction "A". Moreover, in that embodiment, each second corner wall 9 is symmetrical to the other second corner wall 9 with respect to the above-mentioned midplane.

In other words, each first corner wall 8 and/or second corner wall 9 is symmetrical to the other first corner wall 8 and/or second corner wall 9 with respect to a midplane transversal to the front wall 2 and parallel to the main direction "A".

Figure 7A:
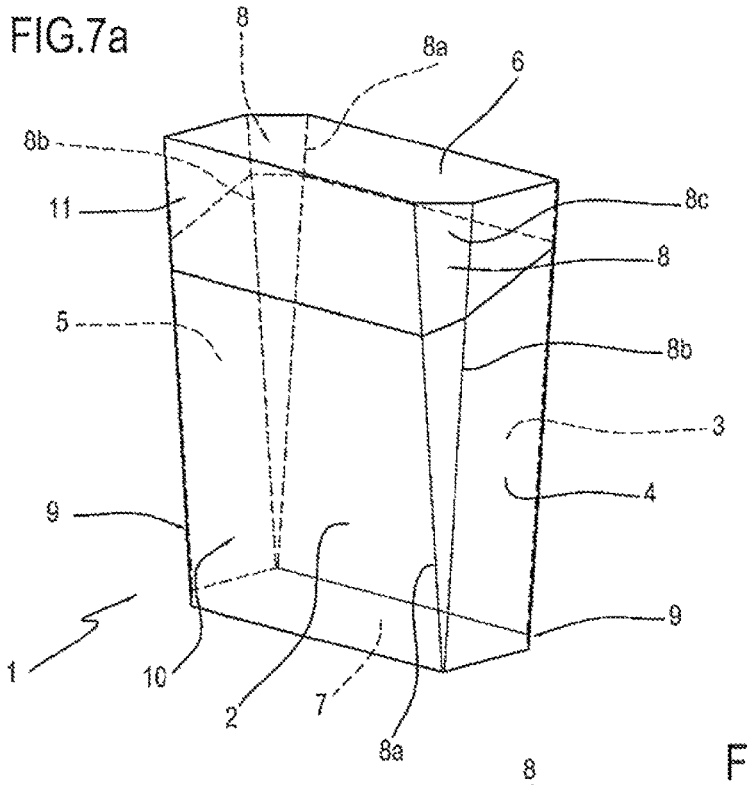
FIGS. 7*a* and 7*b* are front and rear perspective views, respectively, of a third embodiment of the packet according to this invention.
Figure 7B:
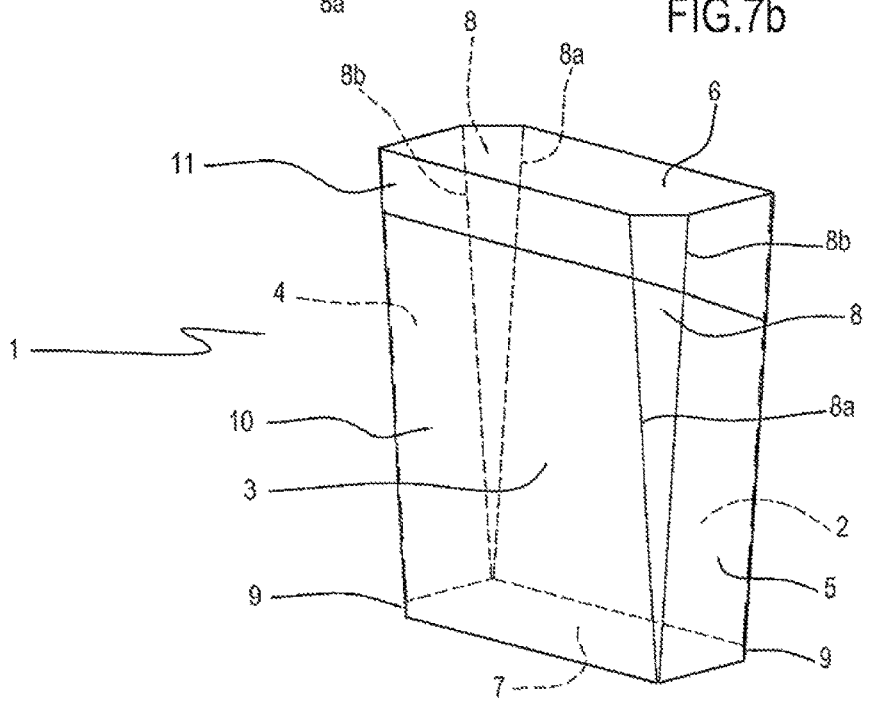
Figure 8:
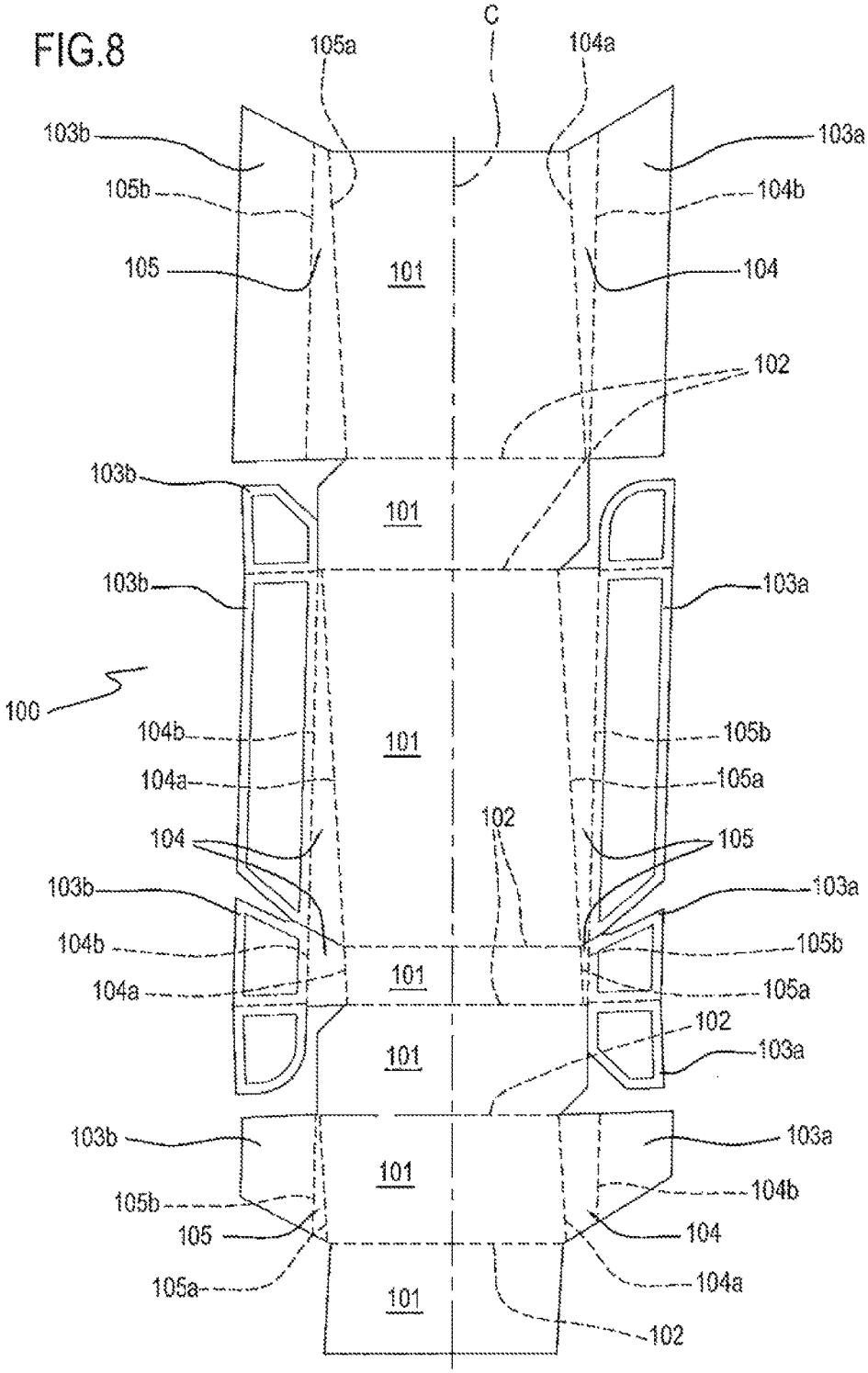
FIG. 8 shows a blank used for making the packet of FIGS. 7*a* and 7*b;*

Alternatively, for example in the embodiment of FIGS. 7*a*, 7*b*, the first corner walls 8 are symmetrical to each other with respect to a plane parallel to main direction "A" and joining two opposite vertices of the bottom wall 7 (or the top wall 6) of the packet 1.

Similarly, the second corner walls 9 are symmetrical to each other with respect to the plane.

Basically, each first corner wall 8 and/or second corner wall 9 is symmetrical to the other first corner wall 8 and/or second corner wall 9 with respect to a plane parallel to main direction "A" and joining two opposite vertices of the bottom wall 7 or the top wall 6.

As already mentioned, but without limiting the scope of the invention, the embodiments illustrated are all relative to a rigid packet for tobacco products of the hinged-lid type.

Consequently, the packet comprises a box body 10 provided with an upper edge 10*a* forming an opening 10*b* for access to the compartment "V" for containing the tobacco products "S" and a lid 11 hinged to the box body 10 at the upper edge 10*a*. More specifically, with reference for example to FIGS. 1 and 2*b*, the lid 11 is hinged along the upper edge 10*a* at the rear wall 3. In this way, the lid 11 can be freely rotated relative to the box body 10 between a position in which the access opening 10*b* is closed and a position in which the access opening 10*b* is open.

In light of this, the first corner wall 8 and the second corner wall 9 (or the first corner walls 8 and the second corner walls 9 in the case of pairs) extend partly on the box body 10 and partly on the lid 11.

Alternatively, each first corner wall 8 and second corner wall 9 can be made only on the box body 10 (FIGS. 10*a*, 10*b*) or only on the lid 11 (not illustrated).

More specifically, the box body 10 extends along the main direction "A" and comprises a front face defining part of the front wall 2, a rear face defining part of the rear wall 3, a pair of side faces defining part of the side walls 4, 5 and a lower face defining the bottom wall 7 of the packet 1.

Similarly, the lid 11 comprises a front face defining part of the front wall 2, a rear face defining part of the rear wall 3, a pair of side faces defining part of the side walls 4, 5 and an upper face defining the top wall 6 of the packet 1.

When it is in the closed position, the faces of the lid 11 are complementary to those of the box body 10 for defining the walls of the packet 1.

The packet 1 also comprises a collar 12 connected to the upper edge 10*a* of the box body 10 in such a way that it rises up from the access opening 10*b*.

The collar 12 is substantially U-shaped in such a way as to define a central notch for taking out the tobacco products (cigarettes).

Thus, the collar 12 has two side walls 12*a*, 12*b* and a front wall 12*c* having an upper edge notched such as to define the "U" shape.

In light of this, the collar 12 comprises at least one corner wall 13, 14 shaped to match a corresponding part 8*c*, 9*c* of the corner wall 8, 9 made in lid 11 and superposed on it when the lid 11 is in the closed position.

Not having a side wall, the collar 12 has a number of corner walls 13, 14 equal to the number of corner walls 8, 9 of the packet 1 associated with the front wall 2.

Consequently, in the embodiments illustrated in FIGS. 1, 5*a*, 5*b*, 7*a*, 7*b*, 12*a*, 12*b* and 13, the collar 12 has two corner walls 13, 14.

In the embodiments illustrated in FIGS. 9*a*, 9*b*, 11*a* and 11*b*, the collar 12 has a single corner wall 13.

The packet 1 described above is preferably made from a flat blank 100, made of paperboard or the like, which also forms an object of this invention. The blank 100 has an axis "C" of longest extension corresponding to the main direction "A" of the packet 1 and is substantially rectangular in shape.

More specifically, the blank 100 comprises a plurality of panels 101 positioned in succession along a direction of longest extension "C" of the blank each connected to the next by a crease line 102 transversal to the direction of longest extension "C".

The panels 101 define the front wall 2, the rear wall 3, the top wall 6 and the bottom wall 7 of the packet 1.

Moreover, the blank 100 comprises a pair of tongues 103*a*, 103*b* positioned on opposite sides of one or more panels 101 wherein each tongue 103*a*, 103*b* defines an inner or outer face of a side wall 4, 5 of the packet 1.

According to the invention, the blank 100 also comprises at least one first tab 104 and second tab 105 each interposed between a tongue 103*a*, 103*b* and the respective panel 101.

Each of the tabs 104, 105 has a transversal dimension variable along the direction of longest extension of the blank 100.

Similarly to what was mentioned above, the term "transversal" is used to mean a dimension transversal (more specifically, at right angles) to the direction of longest extension "C" of the blank 100.

More in detail, each tab 104, 105 extends between a first crease line 104*a*, 105*a* and a second crease line 104*b*.

More specifically, each tab 104, 105 is connected to the respective panel 101 by the first crease line 104*a*, 105*a* and to the respective tongue 103*a*, 103*b* by the second crease line 104*b*. 105*b*.

Consequently, the measurement of the distance between the two crease lines 104*a*, 105*a*, 104*b*, 105*b* of a single tab 104, 105 is variable along the direction of longest extension "C".

It should be noted that the crease lines 104*a*, 105*a*, 104*b*, 105*b* define the edges 8*a*, 8*b*, 9*a*, 9*b* of the corner walls 8, 9 of the packet 1.

Thus, so as to at least partly define the first corner wall 8 and the second corner wall 9 of the packet 1, the first tab 104 has a geometry complementing that of the second tab 105.

Thus, the second crease line 104*b* of the first tab 104 defines a profile complementing the second crease line 105*b* of the second tab 105.

In the embodiments wherein the corner walls 8, 9 extend longitudinally substantially along the entire packet 1, the blank 100 comprises a pair of first tabs 104 and a pair of second tabs 105, each associated with a panel 101.

Each first tab 104 is complementary both to the other first tab 104, aligned with it to define a single first corner wall 8 of the packet 1, and to the second tab 105 to which it is associated to keep constant the transversal dimension of the blank.

Similarly, each second tab 105 is complementary both to the other second tab 105, aligned with it to define a single second corner wall 9 of the packet 1, and to the first tab 104 to which it is associated to keep constant the transversal dimension of the blank.

In the embodiments wherein the packet 1 has four corner walls 8, 9 extending longitudinally substantially along the entire extension of the packet 1, the blank 100 comprises eight tabs 104, 105.

More specifically, the blank 100 comprises four first tabs 104 in associated and complementary pairs and four second tabs 105 in associated and complementary pairs.

Each pair of first tabs 104 is also associated and complementary with a corresponding pair of second tabs 105.

Preferably, each first tab 104 and/or second tab 105 has a triangular or trapezoidal geometry.

In some embodiments, each first tab 104 and/or second tab 105 has a curved surface.

The invention achieves the set aims and brings important advantages.

In effect, due to the presence of the corner walls with the complementary extension, the packet can be easily gripped and at the same time is simple to pack.

In effect, due to the equal and opposite extension of the pairs of corner walls (first with second), the perimeter extension of the packet keeps constant for the entire longitudinal extension of the packet.

Moreover, the use of corner walls inclined in this way eliminates at least partly the presence of sharp corners which make the traditional packets wear the clothes of the user.

Lastly, it should be noted that the particular shape of the packet makes it particularly pleasant and innovative from the point of view of appearance.

The invention claimed is:

1. A packet for tobacco products, the packet substantially shaped as a parallelepiped and extending along a main direction, the packet comprising:

a front wall, a rear wall facing the front wall, a pair of side walls including a first side wall and a second side wall, a bottom wall and a top wall, the bottom wall and the top wall being perpendicular to the main direction and having a same perimeter extension length;

a first pair of corner walls comprising respectively a first corner wall and a second corner wall each having a transversal dimension variable along the main direction;

the first corner wall having a geometry complementary to a geometry of the second corner wall to keep substantially constant a perimeter extension length of a transverse section of the packet along the main direction, the transverse section being defined on a plane perpendicular to the main direction;

wherein the first corner wall is interposed between the first side wall and the front wall and the second corner wall is interposed between the second side wall and the rear wall such that the first and second corner walls are positioned at opposite sides of the packet with respect to a central axis of the packet;

a second pair of corner walls comprising respectively a third corner wall and a fourth corner wall, each having a transversal dimension variable along the main direction;

the third corner wall having a geometry complementary to a geometry of the fourth corner wall to keep substantially constant the perimeter extension length of the transverse section of the packet along the main direction;

wherein the third corner wall is interposed between the second side wall and the front wall and the fourth corner wall is interposed between the first side wall and the rear wall such that the third and fourth corner walls are positioned at opposite sides of the packet with respect to the central axis of the packet;

wherein the first corner wall and the third corner wall converge toward one of the top wall and the bottom wall, and the second corner wall and the fourth corner wall converge toward the other of the top wall and the bottom wall;

a box body including an upper edge forming an opening for access to a compartment for containing the tobacco products;

a lid hinged to the box body at the upper edge to rotate relative to the box body between a position in which the access opening is closed and a position in which the access opening is open; the first and second corner walls extending partly on the box body and partly on the lid.

2. The packet according to claim 1, wherein the first corner wall has an increasing transversal dimension towards the top wall and the second corner wall has a decreasing transversal dimension complementing the first corner wall.

3. The packet according to claim 1, wherein an increase in the transversal dimension of the first corner wall corresponds with a decrease in the transversal dimension of the second corner wall such that a sum of the two transversal dimensions keeps constant along the extension of the packet in the main direction.

4. The packet according to claim 1, wherein each corner wall has a triangular or trapezoidal geometry.

5. The packet according to claim 1, wherein each corner wall has a curved surface for connecting between the side wall and the respective one of the front wall or rear wall.

6. The packet according to claim 1, wherein each corner wall has a cone or truncated cone shaped geometry.

7. The packet according to claim 1, wherein the corner walls of at least one pair of corner walls chosen from 1) the first corner wall and the third corner wall and 2) the second corner wall and the fourth corner wall, are symmetrical to each other with respect to a midplane transversal to the front wall and parallel to the main direction.

8. The packet according to claim 1, and further comprising a collar connected to the upper edge such that the collar rises up from the access opening of the box body, the collar comprising at least one corner wall shaped to match a corresponding part of the corner wall of the lid superposed on the collar when the lid is in the closed position.

9. The packet according to claim 1, wherein the packet is made from a flat blank having a long axis and a substantially rectangular shape made of cardboard.

10. The packet according to claim 1, wherein each of the pair of walls defined by the front and rear walls, the pair of side walls, and the pair of walls defined by the bottom and top walls, exhibits a central symmetry with respect to a central point positioned on the central axis and having a same distance between the bottom wall and the top wall.

* * * * *